US006375516B1

(12) United States Patent
Trinh

(10) Patent No.: US 6,375,516 B1
(45) Date of Patent: Apr. 23, 2002

(54) RJ-45 RECEPTACLE WITH STOPS PREVENTING INSERTION OF RJ-11 PLUGS

(75) Inventor: Michael Trinh, Simi Valley, CA (US)

(73) Assignee: Xircom, Inc., Thousand Oaks, CA (US)

( * ) Notice: Subject to any disclaimer, the term of this patent is extended or adjusted under 35 U.S.C. 154(b) by 0 days.

(21) Appl. No.: 09/408,917

(22) Filed: Sep. 30, 1999

Related U.S. Application Data

(60) Provisional application No. 60/121,636, filed on Feb. 24, 1999.

(51) Int. Cl.[7] ..... H01R 13/64
(52) U.S. Cl. ..... 439/680; 439/676
(58) Field of Search ..... 439/59, 71, 76.1, 439/676, 638, 946, 652, 680

(56) References Cited

U.S. PATENT DOCUMENTS 4,781,626 A * 11/1988 Lazarchik ..... 439/680
4,813,892 A * 3/1989 Strate ..... 439/680
5,876,219 A * 3/1999 Taylor et al. ..... 439/680
5,984,731 A * 11/1999 Laity ..... 439/676
6,074,256 A * 6/2000 Arnett ..... 439/676

FOREIGN PATENT DOCUMENTS

DE 3906421 A 9/1990 ..... H01R/13/645
DE 9309321 U 11/1993 ..... H01R/13/64
DE 9413063 U 10/1994 ..... H02G/3/08

* cited by examiner

*Primary Examiner*—Hien Vu
(74) *Attorney, Agent, or Firm*—Lyon & Lyon LLP

(57) ABSTRACT

An RJ-45 standard modular plug receptacle is defined by walls including a wall defining a plurality of contact wire positions including a pair of outermost contact wire positions. A pair of stops project into the receptacle from a surface of the wall, the stops being in longitudinal alignment with the outermost contact wire positions. An RJ-45 plug is thereby fully insertable in the receptacle with the stops entering the outermost contact pin grooves on the plug during insertion. However, full insertion of an RJ-11 plug is prevented by said stops which engage front faces on the RJ-11 plug flanking the contact pin array of the RJ-11 plug.

8 Claims, 7 Drawing Sheets

RJ-45 RECEPTACLE WITH STOPS PREVENTING INSERTION OF RJ-11 PLUGS

CROSS REFERENCE TO RELATED APPLICATIONS

This application claims the benefit of U.S. Provisional Application No. 60/121,636 filed Feb. 24, 1999.

BACKGROUND OF THE INVENTION

1. Field of the Invention

The present invention relates generally to teledata communications and particularly to industry-standard RJ-type jacks and mating modular plugs commonly used in such systems.

2. Description of the Prior Art

Industry standard RJ-type jacks for receiving mating modular plugs have become extremely common and are now found in virtually every telecommunications and data communications system worldwide, providing wire connections for a vast array of communication devices. Thus, the RJ-11 connector comprises a six-contact plug and corresponding jack commonly used to connect a communications device such as a telephone, facsimile machine or modem to a telephone line. The RJ-45 connector, which is somewhat wider than the RJ-11 connector and includes eight contacts, is commonly used for Ethernet local area network (LAN) connections.

RJ-11 and RJ-45 receptacles are often found proximate one another, for example, as side-by-side wall jacks in office or other commercial or industrial environments, on computers, on adapters, and on PC Cards such as the Xircom RealPort™ integrated Type III PC Card with built-in side-by-side RJ-11 and RJ-45 receptacles allowing a user to plug standard network and modem cables directly into the card. See: U.S. Pat. No. 5,773,332 issued Jun. 30, 1998; U.S. patent application Ser. No. 08/971,501 filed Nov. 17, 1997now U.S. Pat. No. 5,984,731 issued Nov. 16, 1999; and U.S. patent application Ser. No. 09/676,143 filed Mar. 25, 1998, now U.S. Pat. No. 6,116,962 issued Sep. 12, 2000, said patents being incorporated herein by reference in their entireties.

Detailed information regarding the RJ-type or series connectors, including their dimensions, are contained in the U.S. government publication found at Title 47 (Telecommunication), Code of Federal Regulations, Chapter I (Federal Communications Commission), Part 68 (Connection Of Terminal Equipment To The Telephone Network), Subpart F (Connectors), Section 68.500 (Specifications) (rev. Oct. 1, 1998). This publication is accessible at http://www.access.gpo.gov/nara/cfr/waisidx_98/47cfr68_98.html and is incorporated herein by reference in its entirety.

An RJ-series plug includes a generally rectangular contact body or block including uniformly spaced apart grooves into which electrical contact pins are recessed. As indicated, the RJ-11 plug has six such grooves, while the RJ-45 has eight. The RJ-11 and RJ-45 plugs further have standardized retention tabs and tab bases having the same width. The height and other physical characteristics are also the same for both plugs. The spacing between the contacts on the RJ-11 and the RJ-45 modular plugs are identical so that, given the other identical dimensions of these plugs, it is possible to inadvertently insert an RJ-11 plug into a larger RJ-45 jack. As a result, the RJ-11 plug can damage the contact wires inside the RJ-45 jack, especially those contact wires at the outermost contact positions, Nos. 1 and 8. In addition, with an RJ-11 plug connected to a telephone line, the high voltage ring signal could damage a LAN circuit.

SUMMARY OF THE INVENTION

In accordance with one specific, exemplary embodiment of the invention, there is provided a receptacle sized and configured to receive an RJ-45 standard modular plug having a plurality of longitudinally extending contact pin grooves including an outermost groove. The receptacle is defined by walls including a wall having a surface defining a plurality of longitudinally extending contact wire positions including an outermost contact wire position. A stop projecting into the receptacle from the surface of said wall is in longitudinal alignment with the outermost contact wire position. An RJ-45 plug is thus fully insertable into the receptacle, the stop entering the outermost contact pin groove of the RJ-45 plug during insertion. However, full insertion of an RJ-11 plug is prevented by the stop.

BRIEF DESCRIPTION OF THE DRAWINGS

Other features, advantages and benefits of the invention will become evident from the Detailed Description of the Preferred Embodiment, below, when read in conjunction with the accompanying drawings, in which.

DETAILED DESCRIPTION OF THE PREFERRED EMBODIMENT

It will be evident to those skilled in the art that the present invention has broad utility, being applicable wherever an RJ-45 receptacle or jack is found and where there is the possibility of an attempt to insert an RJ-11 modular plug therein. The present invention will be described in detail in the context of a specific environment, namely, a Type III PC card of the kind mentioned above having built-in, side-by-side RJ-45 and RJ-11 modular jacks.

Figure 1:
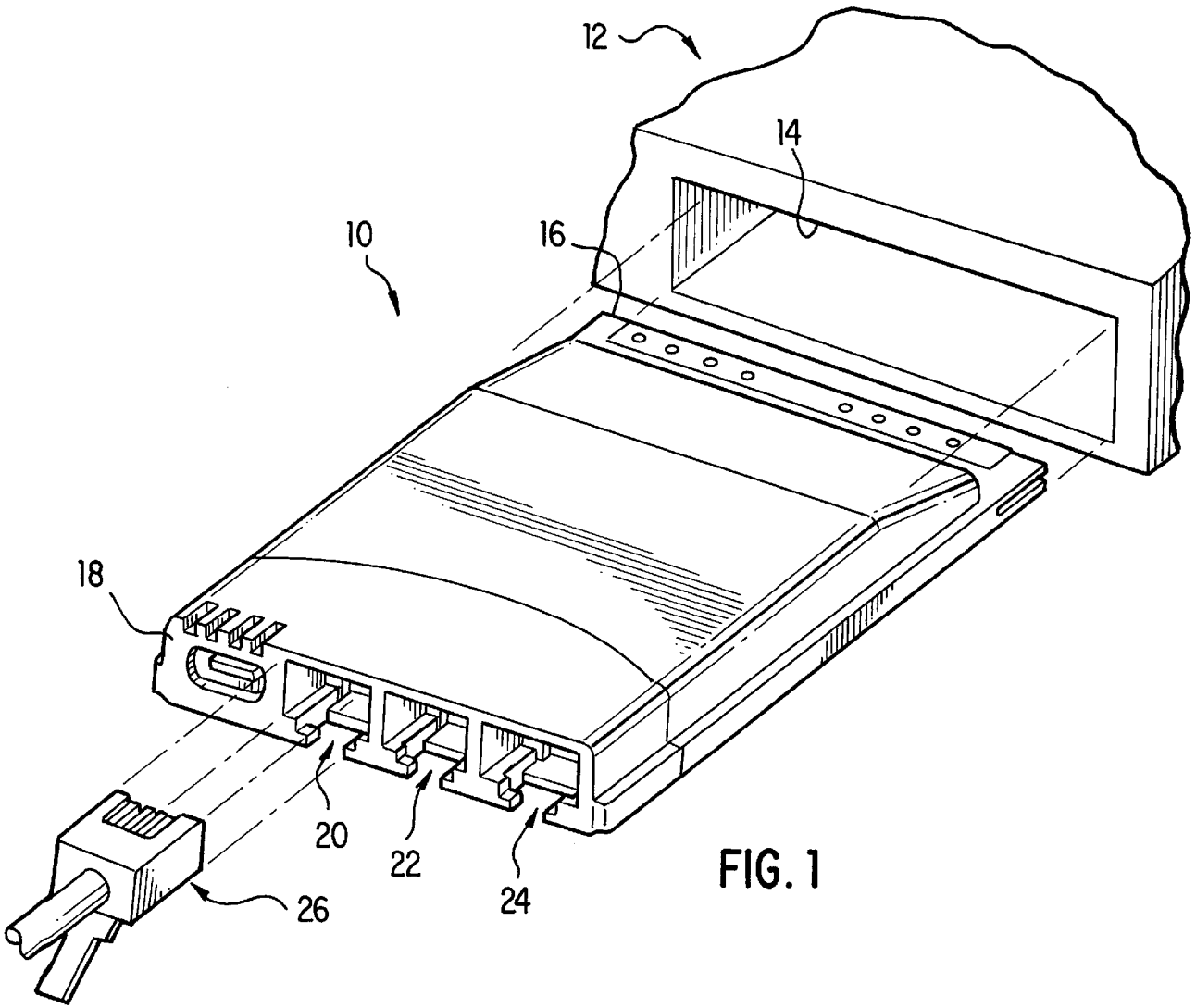
FIG. 1 is a perspective view of a Type III PC card employing the principles of the present invention.

FIG. 1 shows a Type III PC Card 10 for insertion in a standard PCMCIA slot 14 in a host system such as a notebook computer 12. The card 10 includes a front end 16 carrying a standard 68-pin connector and a rear end molded plastic housing portion 18 defining two RJ-11 telephone/modem jacks or receptacles 20 and 22 and an RJ-45 modular Ethernet LAN jack or receptacle 24. As is well known, the RJ-45 receptacle is wider than the RJ-11 receptacle. Prior to the present invention, it was possible to insert a narrower RJ-11 plug, such as the plug 26 shown in FIG. 1, into the wider RJ-45 receptacle 24. As a result, the RJ-11 plug could damage the RJ-45 receptacle and the PC Card's LAN circuit.

Figure 2A:
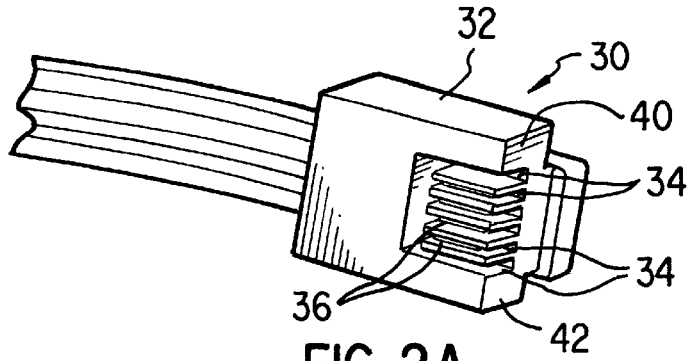
FIGS. 2A and 2B are perspective views of an RJ-11 modular plug.
Figure 2B:
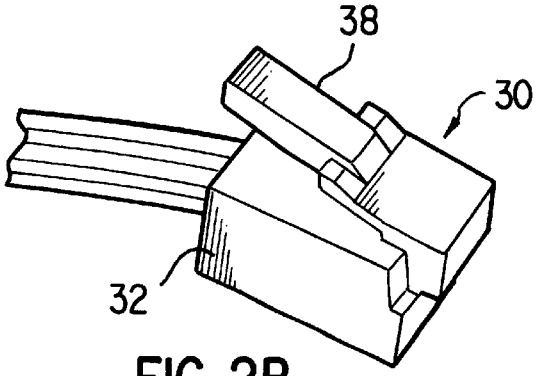
Figure 3A:
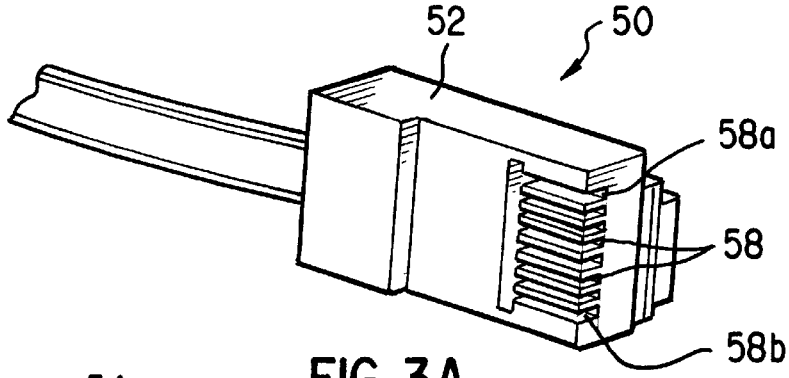
FIGS. 3A and 3B are perspective views of an RJ-45 modular plug.
Figure 3B:
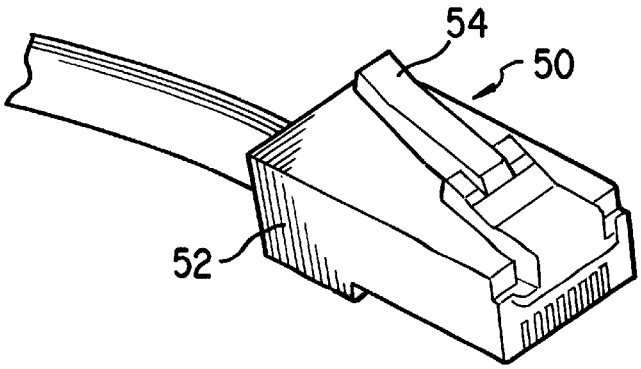
Figure 4:
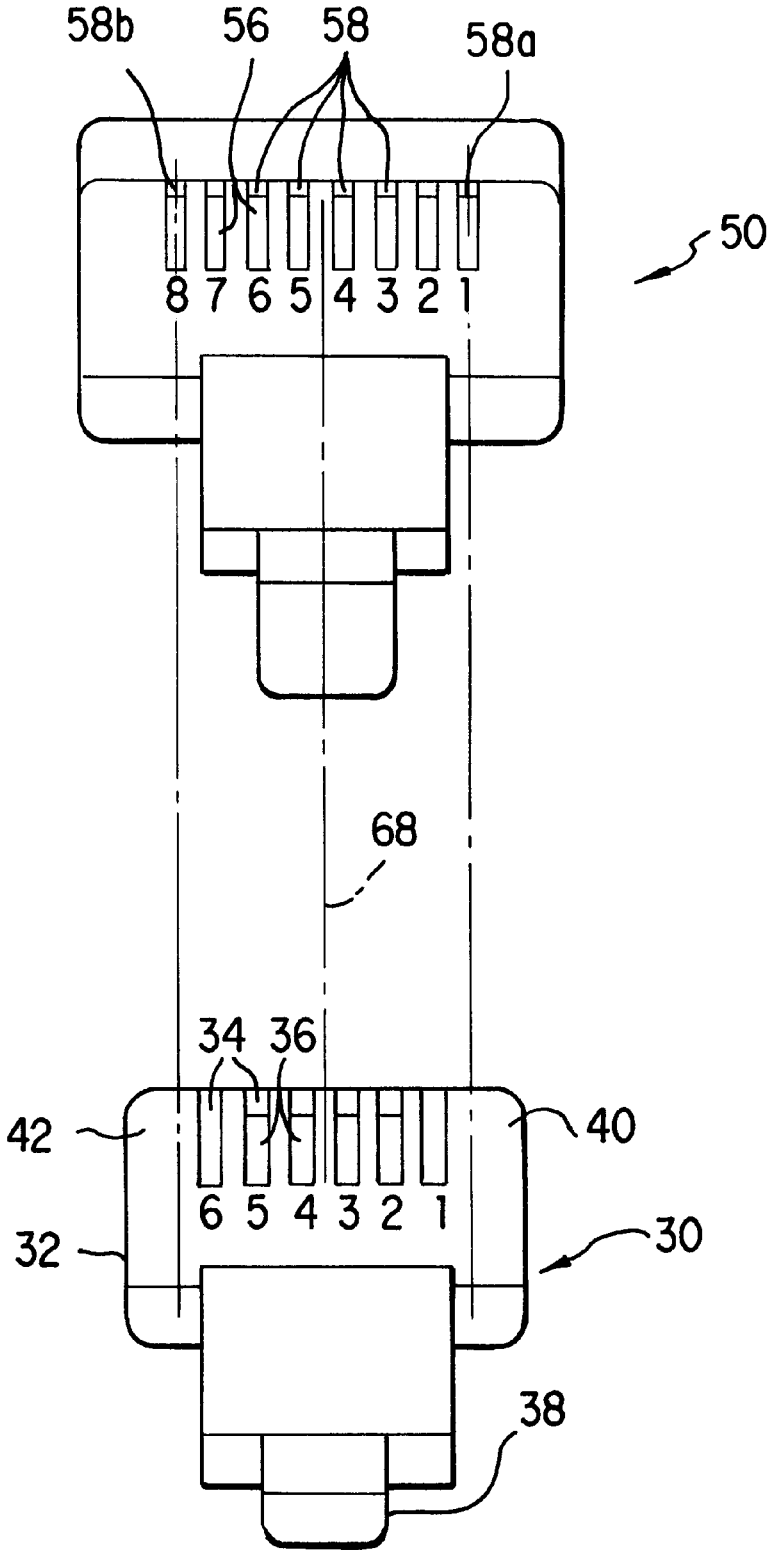
FIG. 4 is a front view of an RJ-11 and an RJ-45 plug in vertical alignment, showing the relative dimensions thereof.
Figure 5:
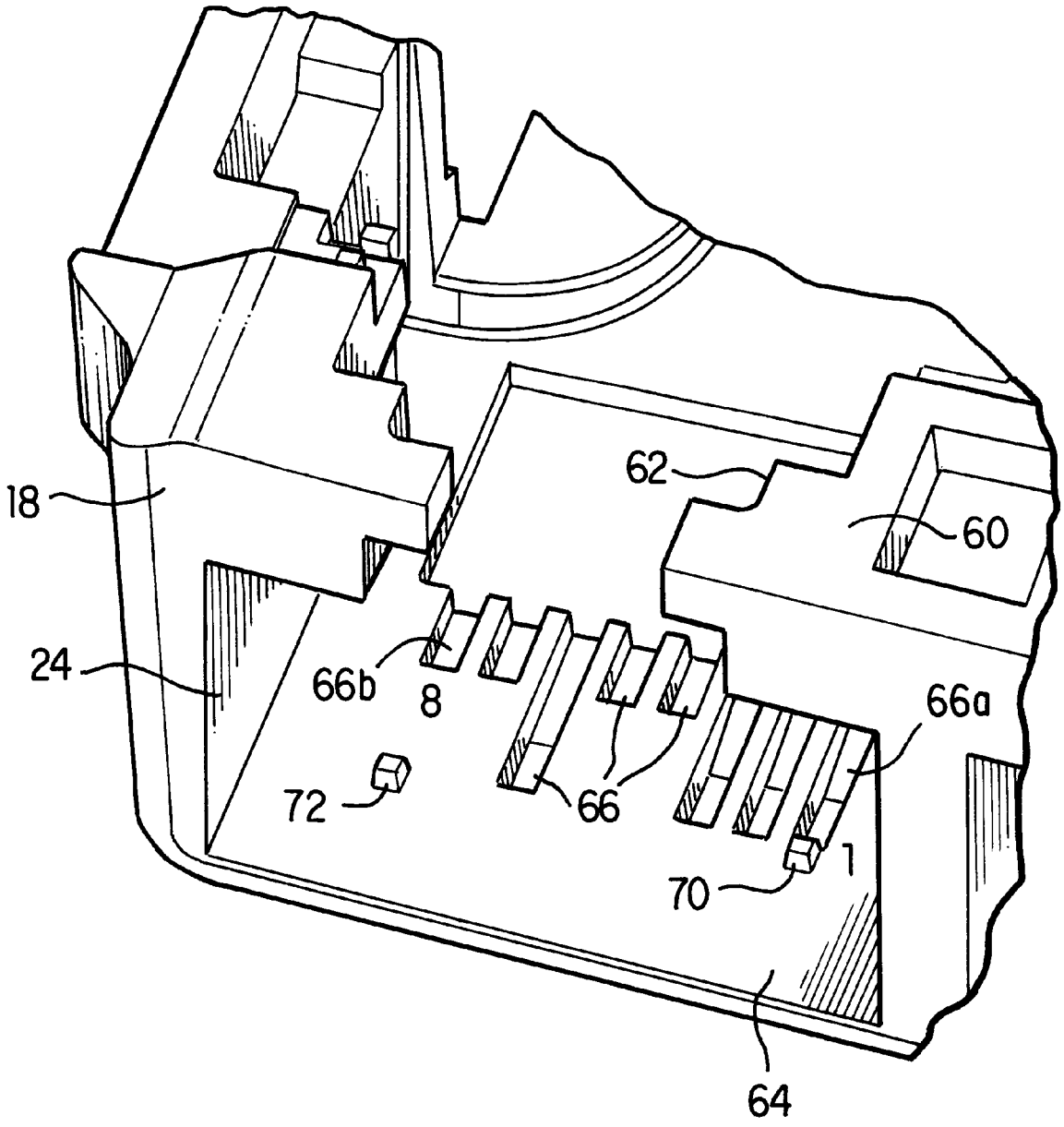
FIG. 5 is an enlarged, perspective view of the RJ-45 receptacle of the PC card shown in FIG. 1.
Figure 6:
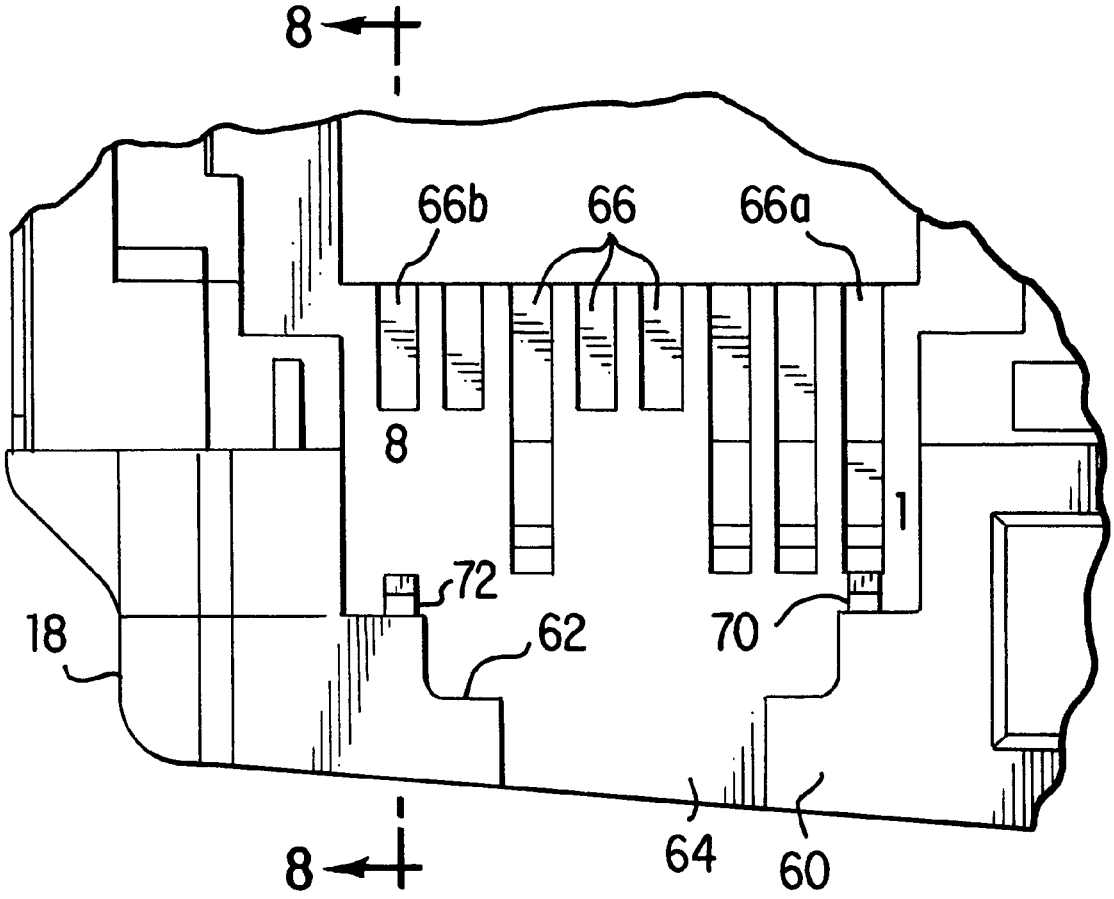
FIG. 6 is a bottom plan view of the RJ-45 receptacle of FIG. 5.
Figure 7:
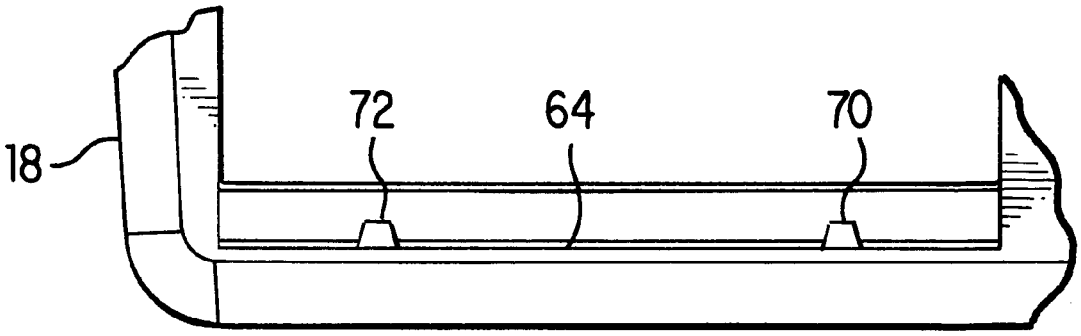
FIG. 7 is an end elevation view of the portion of the receptacle shown in FIGS. 5 and 6.
Figure 8:
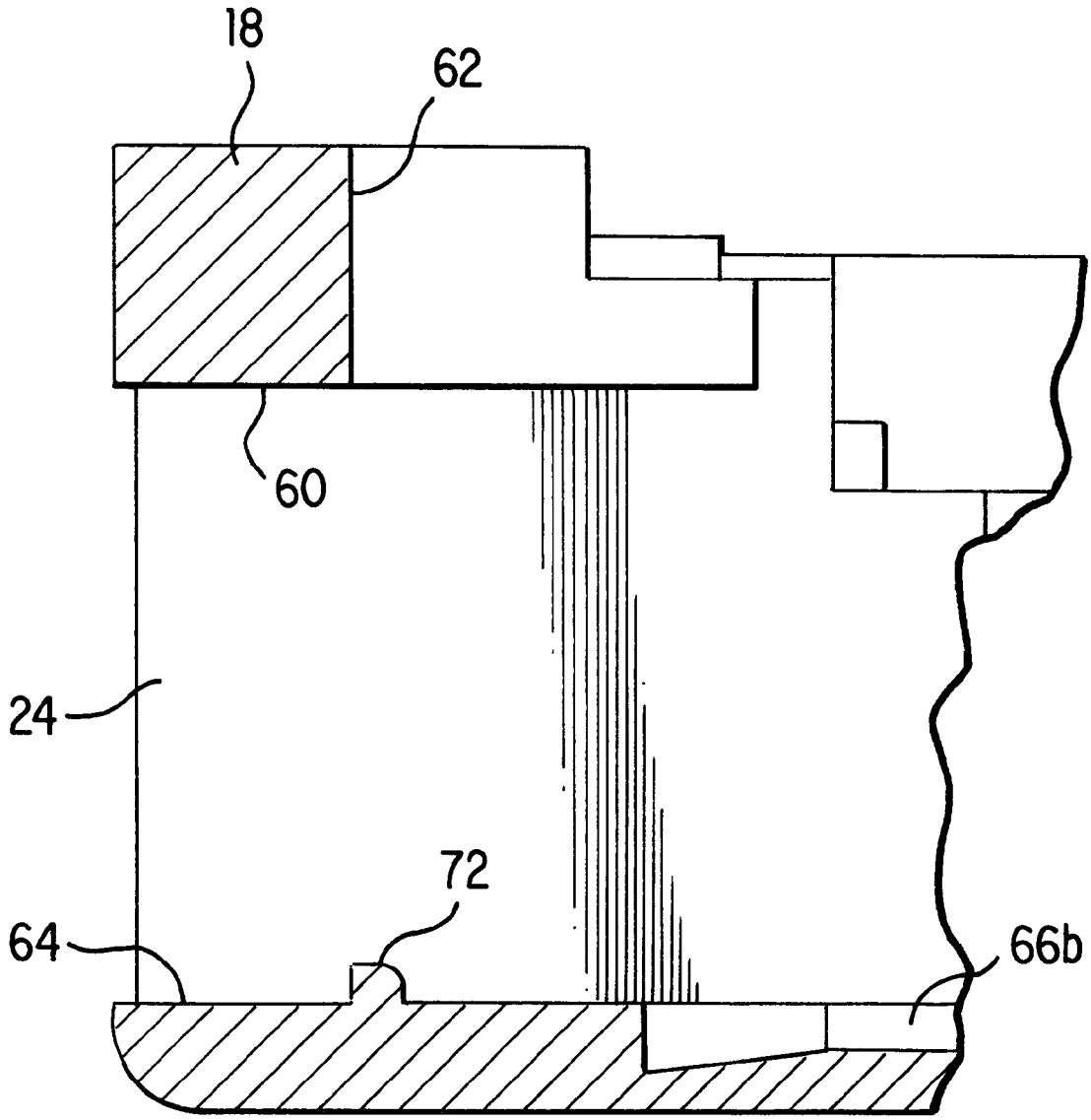
FIG. 8 is a side elevation view in cross section of the receptacle of FIGS. 5–7 as seen along the line 8—8 in FIG. 6.

With reference to FIGS. 2A, 2B and 4, an RJ-11 standard modular connector plug 30 comprises a plastic contact pin block 32, six (6) longitudinal contact array grooves 34 the center four of which contain contact pins 36, and a resiliently biased tension clip 38. Flanking the contact array grooves 34 are bilateral front faces 40 and 42. With reference to FIGS. 3A, 3B and 4, an RJ-45 standard modular connector plug 50 includes a block 52 and a tension clip 54. The RJ-45 plug is similar to the RJ-11 plug except that the RJ-45 is wider so as to accommodate eight contact pins 56 in as many grooves 58 formed in the contact pin block 52. The plug 50 includes outermost grooves 58*a*, 58*b* corresponding to pin position Nos. 1 and 8. FIGS. 5–9 show details of the RJ-45 receptacle 24 defined by the rear housing portion 18 of the card 10. The receptacle 24 is defined by walls including a bottom wall 60 having a generally T-shaped cutout 62 for receiving the tension clip 54 of an RJ-45 plug, and a top wall 64 having formed therein a series of eight longitudinally extending contact wire receiving slots 66 for retaining up to eight contact wires (not shown) connected to a printed circuit board or substrate (not shown) enclosed within the PC Card 10. The outermost slots, at contact wire positions 1 and 8, are identified by reference numerals 66*a* and 66*b*, respectively.

Important to the present invention is that the spacing between the outermost slots 66*a* and 66*b* is such that if the RJ-11 and RJ-45 plugs 30 and 50 are aligned along a common centerline 68 as shown in FIG. 4, the slots 66*a* and 66*b* for contact positions 1 and 8 of the RJ-45 plug line up with the bilateral front faces 40 and 42 of the RJ-11 plug.

Figure 9:
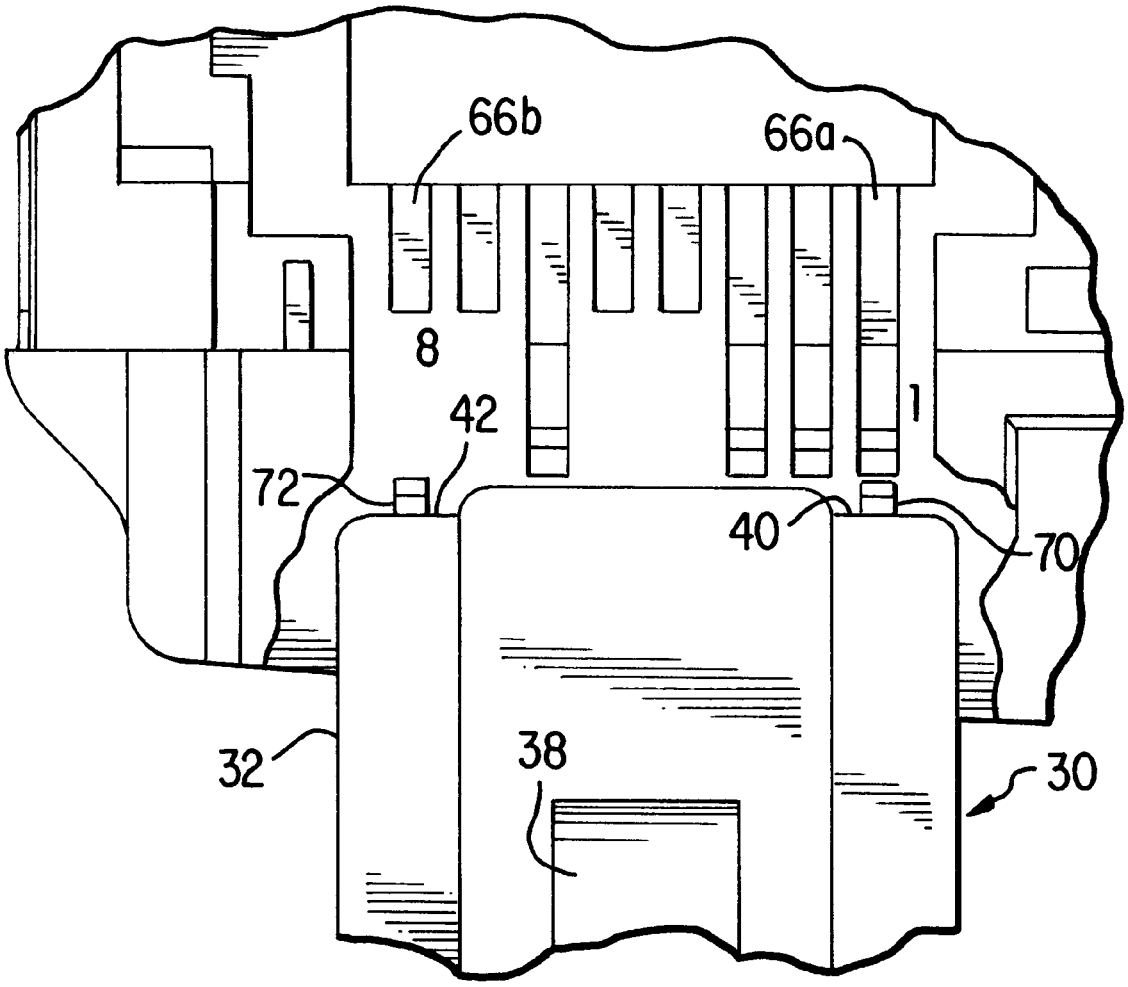
FIG. 9 is a bottom plan view, partly cut away, of the receptacle as seen in FIG. 6 showing an RJ-11 modular plug partially inserted in the receptacle.

The present invention provides for the addition of two small stops 70 and 72 projecting into the RJ-45 receptacle from the top wall 64 thereof. Stop 70 is centered on and in longitudinal alignment with contact wire slot 66*a* (contact position No. 1); stop 72 is centered on and in longitudinal alignment with contact wire slot 66*b* (contact position No. 8). While the stops 70 and 72 allow full insertion of the RJ-45 plug into the RJ-45 receptacle, they block full insertion of an RJ-11 plug. By way of example, each of the stops 70 and 72 may have a length of about 0.024 inch, a width of about 0.020 inch and a height of about 0.017 inch. The stops 70 and 72 are preferably comolded with the molded plastic rear housing portion 18. Thus, when an RJ-45 plug is inserted in the RJ-45 receptacle, the stops 70 and 72 enter the grooves 58*a* and 58*b* of contact positions 1 and 8 on the RJ-45 plug and the RJ-45 plug can be completely inserted within the receptacle. On the other hand, as shown in FIG. 9, when an attempt is made to insert an RJ-11 plug into the RJ-45 receptacle, the bilateral front faces 40 and 42 of the RJ-11 plug engage the stops 70 and 72 preventing complete insertion of the RJ-11 plug.

Although the present invention has been described in detail with reference only to the presently-preferred embodiments, those of ordinary skill in the art will appreciate that various modifications can be made without departing from the invention. For example, although two stops 70 and 72 are preferred, a single stop disposed at contact position 1 or 8 may be utilized. Accordingly, the invention is limited only by the scope of the following claims.

What is claimed is:

1. A receptacle sized and configured to receive an RJ-45 standard modular plug, said plug having a plurality of longitudinally extending contact pin grooves including an outermost groove, the receptacle comprising walls including a wall having a surface defining a plurality of longitudinally extending contact wire slots including an outermost contact wire slot, a stop projecting into the receptacle from the surface of said wall, and being adjacent to an end of the outermost contact wire slot, the stop being in longitudinal alignment with the outermost contact wire slot, an RJ-45 plug being fully insertable in the receptacle, the stop entering the outermost contact pin groove of the RJ-45 plug during insertion, full insertion of an RJ-11 plug being prevented by said stop;

the plurality of longitudinally extending contact pin grooves on the RJ-45 modular plug include a second outermost groove;

the plurality of longitudinally extending contact wire slots include a second outermost contact wire slot; and a second stop projecting into the receptacle in longitudinal alignment with the second outermost contact wire slot, the first and second stops entering the first and second outermost contact pin grooves of the RJ-45 plug during insertion of said plug into the receptacle, full insertion of an RJ-11 plug being prevented by the first and second stops.

2. A device including:

a first jack of a first type having a first plurality of contact slots, said first jack being adapted to receive a matable plug of said first type;

a second jack of a second type having a second plurality of contact slots, said second jack being adapted to receive a matable plug of a second type; and at least one stop in said first jack in alignment with one of said contact slots therein, said stop being configured and positioned so that the at least one stop does not prevent insertion of a plug of the first type but does prevent insertion of a plug of the second type by blocking the insertion into said first jack of the plug of said second type;

said first jack having more contact slots than said second jack, and wherein the at least one stop is adjacent to and in alignment with one or the other of the outermost contact slots.

3. The device, as defined in claim 2, in which the jacks conform to RJ-type standards.

4. The device, as defined in claim 3, in which:

the first jack is an RJ-45 and the second jack is an RJ-11.

5. The device, as defined in claim 2, comprising:

two stops, each stop being in alignment with one of the outermost contact slots.

6. A device adapted to be received by a slot in a host system for connecting the host system to an information transfer system, the device comprising:

a housing having a transverse front end and a rear portion, at least the rear portion of the housing conforming substantially to the PCMCIA Type III thickness standard;

a connector at the front end of the housing adapted to be received by a corresponding connector within the slot of the host system;

at least one forwardly extending receptacle defined by the rear portion of the housing, the at least one receptacle being sized and configured to receive a standard RJ-45 modular plug, the modular plug including contacts, wherein the device is adapted to be directly connectable to the information transfer system utilizing the RJ-45 modular plug;

at least one stop in said at least one receptacle, said at least one stop being positioned and configured to permit full insertion of an RJ-45 plug into said at least one receptacle, and to block insertion into said at least one receptacle of a standard RJ-11 modular plug;

two stops, one of the stops being disposed in alignment with one of the outermost contact slots and the other of said stops being disposed adjacent to and in alignment with the other of the outermost contact slots.

7. A device, as defined in claim 6, in which:

the at least one receptacle includes a pair of outermost contact slots; and said at least one stop is disposed in longitudinal alignment with one of said outermost contact slots.

8. A device, as defined in claim 6, in which:

the rear portion of the housing defines at least a second forwardly extending receptacle, said second receptacle being sized and configured to receive a standard RJ-11 modular plug.

* * * * *